US005738600A

United States Patent [19]

Fouts et al.

[11] Patent Number: 5,738,600

[45] Date of Patent: Apr. 14, 1998

[54] BASKETBALL SHOOTING IMPROVEMENT APPARATUS

[76] Inventors: Clyde Fouts; Marian Smith, both of 2140 Rock Glen, Escondido, Calif. 92026

[21] Appl. No.: 838,890

[22] Filed: Apr. 14, 1997

[51] Int. Cl.[6] ..... A63B 69/00

[52] U.S. Cl. ..... 473/448

[58] Field of Search ..... 473/447, 448, 473/449, 450, 472, 479, 430, 433

[56] References Cited

U.S. PATENT DOCUMENTS

| | | | |
|---|---|---|---|
| 3,342,486 | 9/1967 | Farley | 473/448 |
| 4,213,606 | 7/1980 | Wilson | 473/448 |
| 4,226,416 | 10/1980 | Callanan | 473/448 |
| 4,506,886 | 3/1985 | Lamb, Sr. | 473/447 |
| 4,621,811 | 11/1986 | Campbell | 473/430 |
| 4,836,539 | 6/1989 | Knapp | 473/433 |
| 5,354,048 | 10/1994 | Winesberry, Jr. | 473/447 |
| 5,364,092 | 11/1994 | Riepe et al. | 473/448 |
| 5,665,016 | 9/1997 | Burnett | 473/448 |

*Primary Examiner*—William H. Grieb

[57] ABSTRACT

A basketball shooting improvement apparatus includes a base member which includes a front side, a rear side, and two transverse sides extending between the front side and the rear side. The base member is oriented in a first plane, and hook members are connected to the base member. The hook members include downwardly descending hook ends which descend below the first plane, and the hook members extend beyond the front side of the base member. The hook members extend from the transverse sides of the base member. A tension clamp assembly is connected to the base member. A riser member, supported by the base member, extends upward from the base member. The riser member includes a distal end, and a check point assembly is connected to the distal end of the riser member. The riser member may include an ascending riser portion which ascends above the base member. A transverse riser portion is connected to the ascending riser portion. The transverse riser portion extends beyond the hook ends of the hook members. The check point assembly includes a check point member located above the base member by an elevation distance. The check point assembly includes structures to enable the elevation distance of the check point member above the base member to be adjusted.

5 Claims, 3 Drawing Sheets

BASKETBALL SHOOTING IMPROVEMENT APPARATUS

BACKGROUND OF THE INVENTION

1. Field of the Invention

The present invention relates generally to the game of basketball and, more particularly, to devices especially adapted for improving accuracy in shooting baskets.

2. Description of the Prior Art

Throughout the years, a number of innovations have been developed relating to devices for improving one's accuracy in shooting baskets in basketball, and the following U.S. patents are representative of some of those innovations: U.S. Pat. Nos. 4,213,606, 4,226,416, 4,506,886, 4,621,811, 4,836,539, and 5,364,092. More specifically, U.S. Pat. Nos. 4,213,606, 4,226,416, 4,836,539, and 5,364,092 disclose basketball shooting improvement devices which employ auxiliary hoops or cylindrical devices attached to the basketball hoop. Although well intentioned, such devices modify the effective geometry of the basketball hoop. In this respect, it would be desirable if a basketball shooting improvement device were provided which does not alter the effective geometry of the basketball hoop.

U.S. Pat. No. 4,506,886 discloses the general idea of mounting a basketball target above the basketball hoop so that the target is centered with respect to the center of the hoop. This target is permanently mounted on the backboard above the hoop. As a result, the mounting structures interfere with normal backboard rebound action. In this respect, it would be desirable if a basketball shooting improvement device were provided which is not mounted on the backboard above the hoop and does not interfere with normal backboard rebound action.

Moreover, U.S. Pat. No. 4,506,886 also discloses that the target is used for aiming the basketball when shooting. It has been learned from detailed analyses of basketball shots that, in addition to aiming, proper follow-through is important for success in free throw attempts. None of the prior art cited discloses a technique for improving one's follow-through. In this respect, it would be desirable if a basketball shooting improvement device were provided which facilitates a person's improving one's follow-through when shooting.

U.S. Pat. No. 4,621,811 discloses a basketball training aid which employs a ball tethered to a support which is supported by the hoop support bracket which supports the hoop and is located between the hoop and the backboard. The tethered ball may aid in the improvement of shots which are relatively close to the hoop. However, for distant shots, the tethered ball is not practical. In this respect, it would be desirable if a basketball shooting improvement device were provided which does not employ a tethered ball.

Thus, while the foregoing body of prior art indicates it to be well known to use various devices for improving basketball shooting accuracy, the prior art described above does not teach or suggest a basketball shooting improvement apparatus which has the following combination of desirable features: (1) does not alter the effective geometry of the basketball hoop; (2) is not mounted on the backboard above the hoop and does not interfere with normal backboard rebound action; (3) facilitates a person's improving one's follow-through when shooting; and (4) does not employ a tethered ball. The foregoing desired characteristics are provided by the unique basketball shooting improvement apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a basketball shooting improvement apparatus which includes a base member which includes a front side, a rear side, and two transverse sides extending between the front side and the rear side. The base member is oriented in a first plane, and hook members are connected to the base member. The hook members include downwardly descending hook ends which descend below the first plane, and the hook members extend beyond the front side of the base member. The hook members extend from the transverse sides of the base member. A tension clamp assembly is connected to the base member. A riser member, supported by the base member, extends upward from the base member. The riser member includes a distal end, and a check point assembly is connected to the distal end of the riser member.

The riser member may include an ascending riser portion which ascends above the base member. A transverse riser portion is connected to the ascending riser portion. The transverse riser portion extends beyond the hook ends of the hook members. Preferably, the riser member is made from pliable material.

The check point assembly includes a check point member located above the base member by an elevation distance. The check point assembly may include a shaft member which is connected to the riser member. The check point member is connected to the shaft member. The shaft member includes a lock channel, and the distal end of the transverse riser portion includes a plurality of pairs of pin-receiver channels. The lock channel of the shaft member can be placed in registration with selected pairs of the pin-receiver channels. A lock pin is inserted through a selected pair of the pin-receiver channels and through the lock channel for locking the check point assembly in a selected position with respect to the transverse riser portion.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved basketball shooting improvement apparatus which has all of the advantages of the prior art and none of the disadvantages.

It is another object of the present invention to provide a new and improved basketball shooting improvement apparatus which may be easily and efficiently manufactured and marketed.

It is a further object of the present invention to provide a new and improved basketball shooting improvement apparatus which is of durable and reliable construction.

An even further object of the present invention is to provide a new and improved basketball shooting improvement apparatus which is susceptible of a low cost of manufacture with regard to both materials and labor, and which accordingly is then susceptible of low prices of sale to the consuming public, thereby making such basketball shooting improvement apparatus available to the buying public.

Still yet a further object of the present invention is to provide a new and improved basketball shooting improvement apparatus which does not alter the effective geometry of the basketball hoop.

Still another object of the present invention is to provide a new and improved basketball shooting improvement apparatus that is not mounted on the backboard above the hoop and does not interfere with normal backboard rebound action.

Yet another object of the present invention is to provide a new and improved basketball shooting improvement apparatus which facilitates a person's improving one's follow-through when shooting.

Even another object of the present invention is to provide a new and improved basketball shooting improvement apparatus that does not employ a tethered ball.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
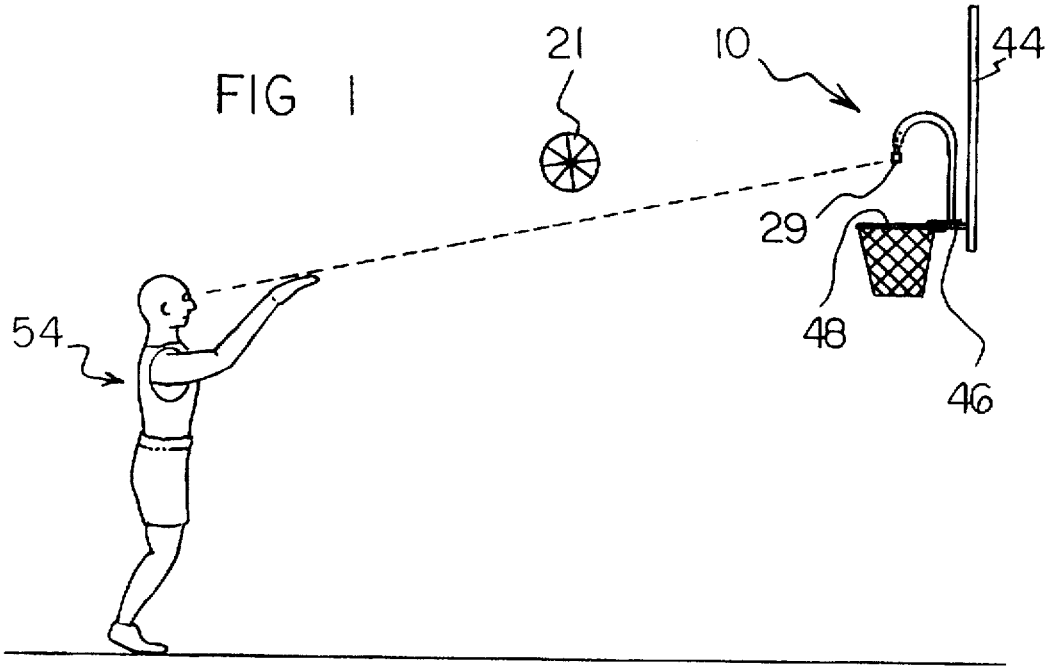
FIG. 1 is a side view showing a preferred embodiment of the basketball shooting improvement apparatus of the invention being used by a player to monitor his follow-through by aligning his wrist on a line between his eye and the target of the invention.
Figure 2:
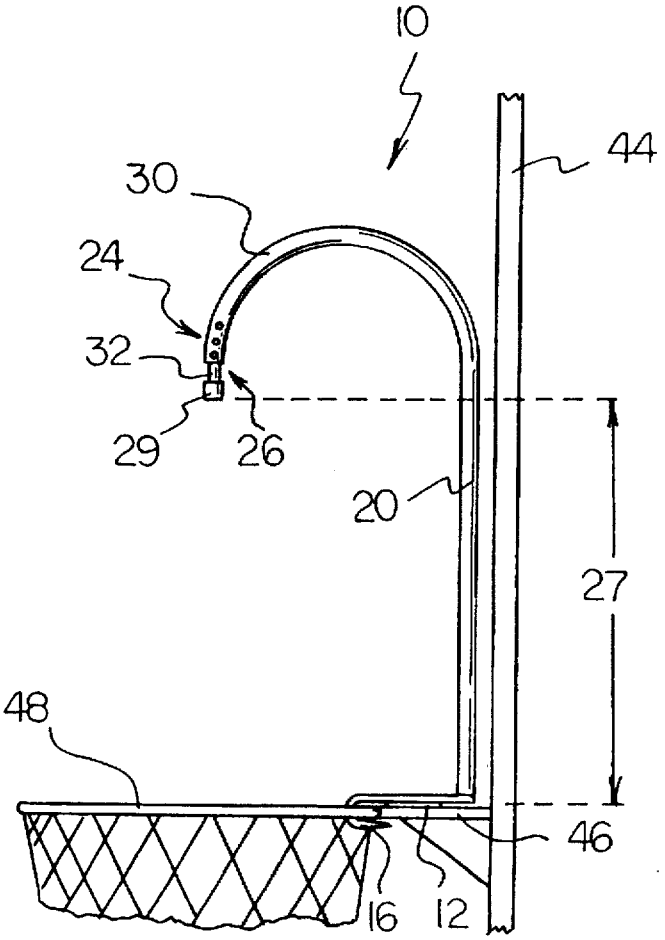
FIG. 2 is an enlarged side view of the embodiment of the basketball shooting improvement apparatus shown in FIG. 1, installed on a hoop support bracket.
Figure 3:
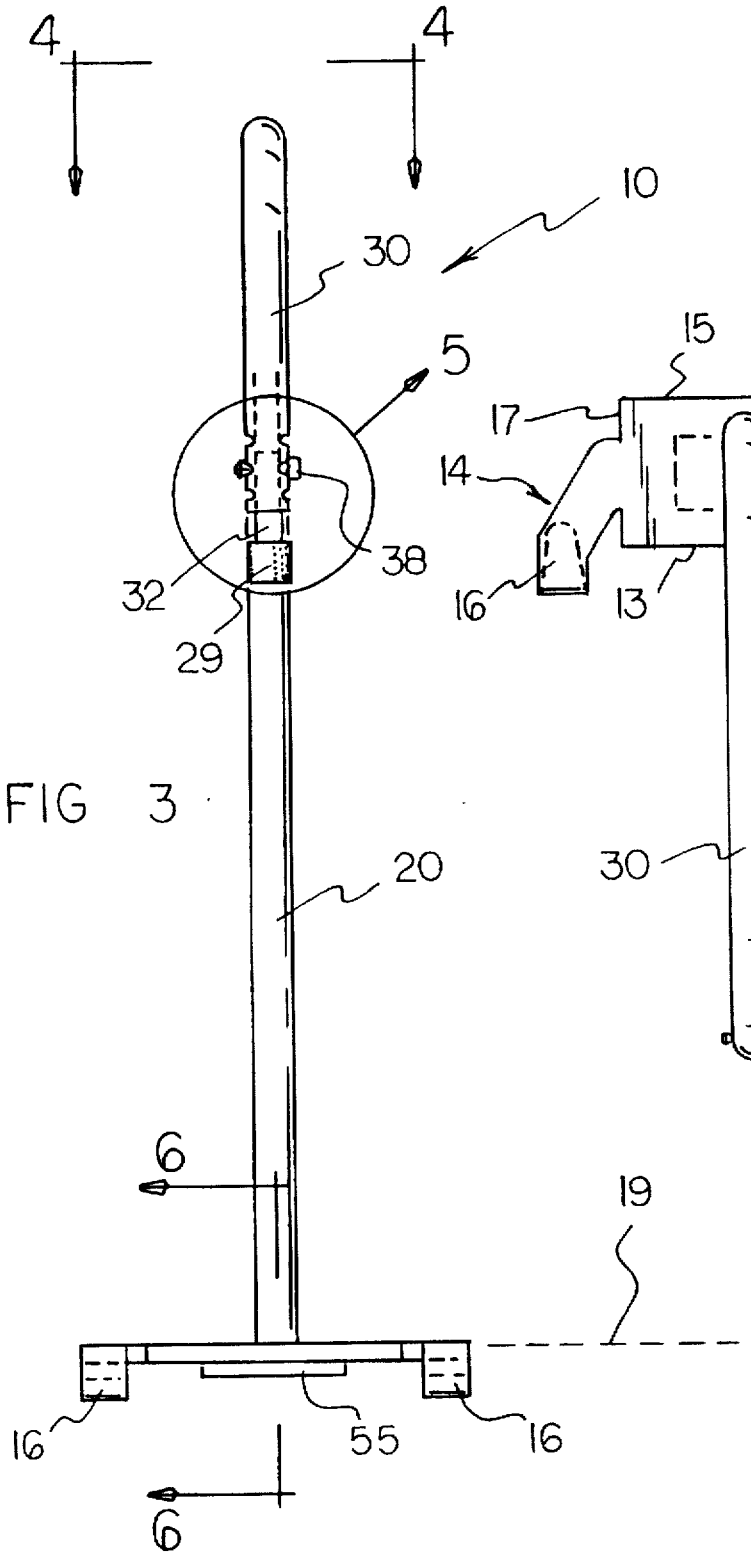
FIG. 3 is an enlarged front view of the embodiment of the basketball shooting improvement apparatus of FIG. 2 removed from the hoop support bracket.
Figure 4:
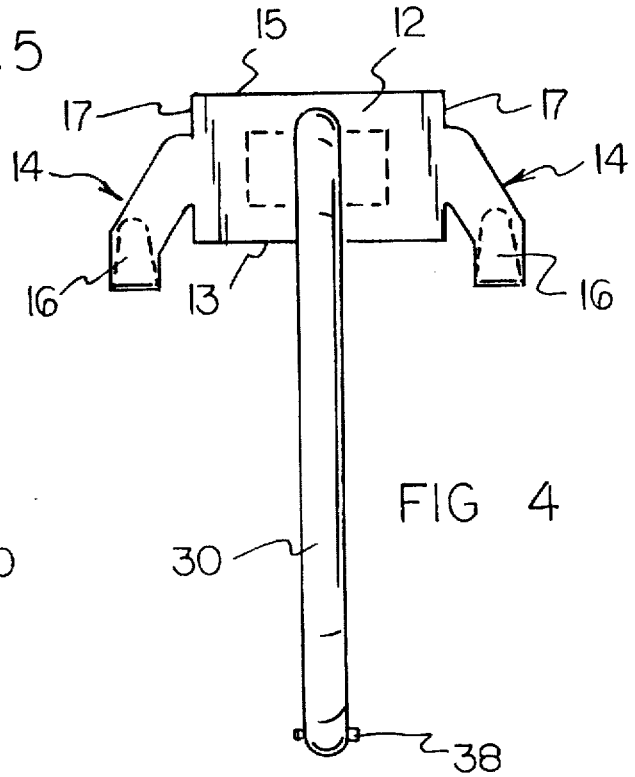
FIG. 4 is a top view of the embodiment of the invention shown in FIG. 3 taken along line 4—4 thereof.
Figure 5:
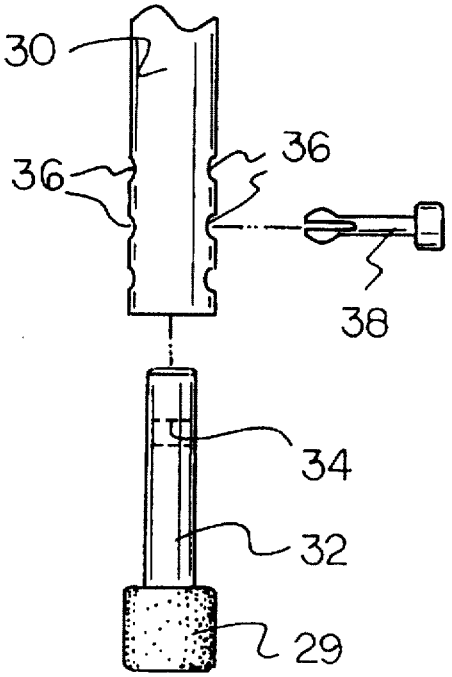
FIG. 5 is an enlarged, exploded view of the portion of the embodiment of the invention shown in circled region 5 of FIG. 3.
Figure 6:
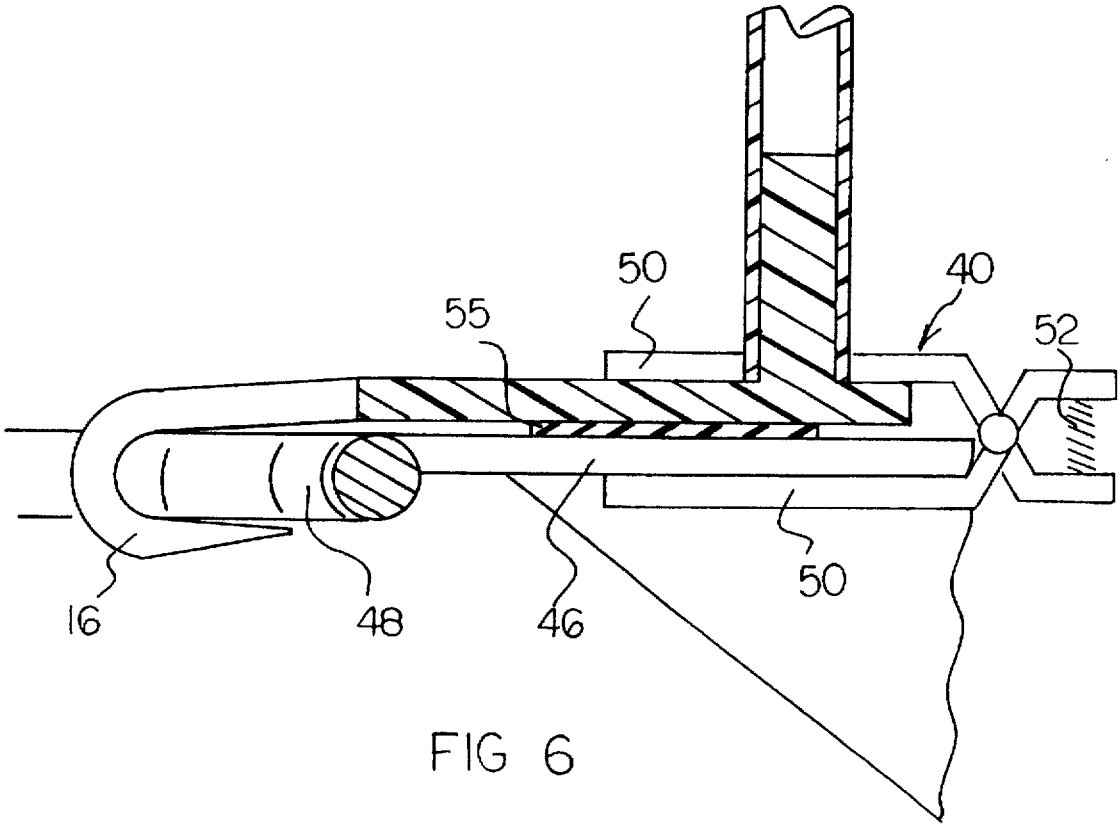
FIG. 6 is an enlarged cross-sectional view of the portion of the embodiment of the invention shown in FIG. 3 taken along lines 6—6 thereof, with the basketball shooting improvement apparatus installed on the hoop support bracket.

With reference to the drawings, a new and improved basketball shooting improvement apparatus embodying the principles and concepts of the present invention will be described.

Turning to FIGS. 1–6, there is shown an exemplary embodiment of the basketball shooting improvement apparatus of the invention generally designated by reference numeral 10. In its preferred form, basketball shooting improvement apparatus 10 includes a base member 12 which includes a front side 13, a rear side 15, and two transverse sides 17 extending between the front side 13 and the rear side 15. The base member 12 is oriented in a first plane 19, and hook members 14 are connected to the base member 12. The hook members 14 include downwardly descending hook ends 16 which descend below the first plane 19, and the hook members 14 extend beyond the front side 13 of the base member 12. The hook members 14 extend from the transverse sides 17 of the base member 12. A tension clamp assembly 40 is connected to the base member 12. The tension clamp assembly 40 has clamping arms 50, and the clamping arms 50 are urged towards each other by tension spring 52. A riser member, supported by the base member 12, extends upward from the base member 12. The riser member includes a distal end 24, and a check point assembly 26 is connected to the distal end 24 of the riser member.

The check point assembly 26 includes a cheek point member 29 located above the base member 12 by an elevation distance 27. The elevation distance 27 is greater than the diameter of a basketball 21. Preferably, the check point member 29 is made from a soft, flexible material.

The riser member may include an ascending riser portion 20 which ascends above the base member 12. A transverse riser portion 30 is connected to the ascending riser portion 20. The transverse riser portion 30 extends beyond the hook ends 16 of the hook members 14. Preferably, the riser member is made from pliable material.

The check point assembly 26 may include a shaft member 32 which is connected to the riser member. The check point member 29 is connected to the shaft member 32. The shaft member 32 includes a lock channel 34, and the distal end of the transverse riser portion 30 includes a plurality of pairs of pin-receiver channels 36. The lock channel 34 of the shaft member 32 can be placed in registration with selected pairs of the pin-receiver channels 36. A lock pin 38 is inserted through a selected pair of the pin-receiver channels 36 and through the lock channel 34 for locking the check point assembly 26 in a selected position with respect to the transverse riser portion 30. By adjusting the locked position of the shaft member 32 with respect to the transverse riser portion 30, the elevation distance 27 of the cheek point member 29 with respect to the base member 12 can be adjusted.

To use the basketball shooting improvement apparatus 10 of the invention, the apparatus 10 is first installed on an existing backboard and hoop combination. More specifically, a backboard 44 has a hoop support bracket 46 connected to it. A hoop 48 is connected to the hoop support bracket 46. To install the basketball shooting improvement apparatus 10 of the invention, the base member 12 is placed upon the hoop support bracket 46. If desired, a resilient pad 55 can be placed between the hoop support bracket 46 and the base member 12. The hook ends 16 of the hook members 14 are placed in engagement with portions of the hoop 48. The base member 12 is moved towards the backboard 44 so that the hook ends 16 of the hook members 14 firmly engage the hoop 48 such as most clearly shown in FIGS. 2 and 6. Then, the tension clamp assembly 40 is installed. That is, the tension clamp assembly 40 is installed so that the clamping arms 50 clamp the base member 12 together on the top surface of the hoop support bracket 46. When the basketball shooting improvement apparatus 10 is installed on the hoop support bracket 46, the ascending riser portion 20 of the riser member orients the check point member 29 so that the check point member 29 is located an elevation distance 27 above the base member 12. In addition, the transverse riser portion 30 of the riser member positions the check point member 29 centrally located with respect to the center of the hoop 48.

Once installed, the basketball shooting improvement apparatus 10 can be used in the following way. As shown in FIG. 1, a player 54 shoots a basketball 21 towards the hoop 48. For most desirable shooting form, the player 54 shoots in such a way that after the basketball 21 is airborne, the player 54 can align one of his eyes with the wrist of the shooting arm with the check point member 29. When a basketball 21 is shot so that the player 54 can align his eye with his wrist with the check point member 29, then the player 54 has made the shot with desirable form.

More specifically, the check point member 29 is positioned to mark the center of the hoop 48 in a position somewhat elevated above the hoop 48. By a player 54 aligning his eye and wrist with the check point member 29 as described above, the player 54 is trained to have a high straight release and to maintain a proper follow-through. Stated somewhat differently, the check point member 29 is the target to which the fingers and wrist should point when the basketball 21 is released to the basket.

The components of the basketball shooting improvement apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved basketball shooting improvement apparatus that is low in cost, relatively simple in design and operation, and which may advantageously be used without altering the effective geometry of the basketball hoop. With the invention, a basketball shooting improvement apparatus is provided which is not mounted on the backboard above the hoop and does not interfere with normal backboard rebound action. With the invention, a basketball shooting improvement apparatus is provided which facilitates a person's improving one's follow-through when shooting. With the invention, a basketball shooting improvement apparatus is provided which does not employ a tethered ball.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A basketball shooting improvement apparatus, comprising:

a base member which includes a front side, a rear side, and two transverse sides extending between said front side and said rear side, wherein said base member is oriented in a first plane, hook members connected to said base member, wherein said hook members include downwardly descending hook ends which descend below said first plane, and wherein said hook members extend beyond said front side of said base member, a tension clamp assembly connected to said base member, a riser member, supported by said base member, which extends upward from said base member, wherein said riser member includes a distal end, and a check point assembly connected to said distal end of said riser member, wherein said check point assembly includes a check point member located above said base member by an elevation distance.

2. The apparatus of claim 1 wherein said hook members extend from said transverse sides of said base member.

3. The apparatus of claim 1 wherein said riser member includes:

an ascending riser portion which ascends above said base member, and a transverse riser portion connected to said ascending riser portion, wherein said transverse riser portion extends beyond said hook ends of said hook members.

4. The apparatus of claim 1 wherein said check point assembly includes:

a shaft member connected to said riser member, wherein said check point member is connected to said shaft member.

5. The apparatus of claim 4 wherein:

said shaft member includes a lock channel, said distal end of said transverse riser portion includes a plurality of pairs of pin-receiver channels, wherein said lock channel of said shaft member can be placed in registration with selected pairs of said pin-receiver channels, and a lock pin, inserted through a selected pair of said pin-receiver channels and through said lock channel, for locking said check point assembly in a selected position with respect to said transverse riser portion.

* * * * *